United States Patent [19]

Polosky

[11] Patent Number: 4,711,419

[45] Date of Patent: Dec. 8, 1987

[54] BOOK OR SIMILAR ARTICLE HANGING DEVICE

[76] Inventor: Charles T. Polosky, 300 Hunters Glenn Ct., Atlanta, Ga. 30328

[21] Appl. No.: 917,038

[22] Filed: Oct. 9, 1986

[51] Int. Cl.[4] ..... E04G 5/06

[52] U.S. Cl. ..... 248/225.2; 211/42; 211/94; 248/359; 248/360; 281/15 A

[58] Field of Search ..... 281/15 A; 402/4, 500; 211/94, 40, 41, 42; 312/245; 108/152; 248/225.2, 222.2, 215, 317, 339, 340, 359 A, 359 I, 359, 360

[56] References Cited

U.S. PATENT DOCUMENTS

| | | | |
|---|---|---|---|
| 237,163 | 2/1881 | Brumm | 281/34 |
| 856,748 | 6/1907 | Ward | 281/15 A X |
| 869,379 | 10/1907 | Mills | 281/15 A |
| 1,088,012 | 2/1914 | Dear | 281/15 A |
| 1,133,655 | 3/1915 | Morgan | 281/15 A |
| 1,238,899 | 9/1917 | Enell | 248/447 |
| 1,379,719 | 5/1921 | Parsons | 281/15 A |
| 1,475,451 | 11/1923 | Schwartz | 281/15 A |
| 1,680,302 | 8/1982 | O'Connor | 281/15 A |
| 1,798,656 | 3/1931 | Chapman | 281/16 |
| 2,215,163 | 9/1940 | Shedd | 281/15 A |
| 2,523,129 | 9/1950 | Maier | 281/17 X |
| 3,174,626 | 3/1965 | West | 281/15 A |
| 3,298,646 | 1/1967 | VanBuren, Jr. | 248/903 |
| 3,311,435 | 3/1967 | Heritage | 248/224.2 X |
| 3,826,582 | 7/1974 | Podosek | 281/15 A X |
| 4,181,381 | 1/1980 | St Amand | 281/15 A X |
| 4,200,945 | 5/1980 | Ellis | 281/15 A X |

FOREIGN PATENT DOCUMENTS

| | | | |
|---|---|---|---|
| 188962 | 11/1905 | Fed. Rep. of Germany | 402/4 |
| 357706 | 1/1962 | Switzerland | 281/15 A |
| 2013080 | 8/1979 | United Kingdom | 281/15 A |

*Primary Examiner*—J. Franklin Foss
*Assistant Examiner*—David L. Talbott
*Attorney, Agent, or Firm*—Wood, Herron & Evans

[57] ABSTRACT

An article hanging device for books, records or similar articles is disclosed which includes a tab for mounting on the article and a rail for mounting the article on a vertical surface. The tab is provided with a uniquely designed hook means having surfaces which mate with corresponding surfaces on the rail to facilitate quick and easy storage or retrieval of the article. The tab is preferably made of thin gauge high tensile aluminum and the rail is made of plastic. Books or similar articles of all sizes and weights can be displayed economically and decoratively with the device.

14 Claims, 4 Drawing Figures

BOOK OR SIMILAR ARTICLE HANGING DEVICE

BACKGROUND OF THE INVENTION

The most common method of storing books, records and similar articles has been to stack them on shelves or in cabinets. Shelves and cabinets are generally expensive and take up considerable amounts of wall and floor space. Considerable efforts have been made as evidenced by the patent literature to improve various hanging devices for books and similar articles such as records, files and the like. As examples of the state of the art, the following list of patents is offered as general background information for this invention and it is not intended by their listing that they are either relevant or represent the most relevant prior art; U.S. Pat. Nos. 237,163; 856,748; 869,379; 1,088,012; 1,133,655; 1,238,899; 1,379,719; 1,475,451; 1,680,302; 1,779,095; 1,798,656; 2,215,163; 2,523,129; 3,174,626; 3,826,582; 4,181,381 and 4,200,945; Swiss Pat. No. 357,706; German Pat. No. 1,218,995; French Pat. No. 1,480,273 and British Pat. Appln. No. 2,013,080.

As may be appreciated by the above patent art covering the time from the early 1900's, many hanging devices or holders of books for mounting on vertical surfaces have been proposed. Hook-like members have been recessed in either the cover or a corner of the book for cooperation with rails that have been mounted on a wall. An example of such a hanging device is shown in Swiss Pat. No. 357,706 (1958), issued to Sutter which discloses a book hanger assembly in which hooks are strategically recessed in the front and back cover portions of a book for mounting on a rail member with a lower bar supporting the lower edge of the book on the vertical surface. Another example of a hanging device assembly is disclosed in U.K. Pat. Appln. No. 2,013,080 (1979) which discloses one or more hook members adapted to be rigidly secured to an object and an elongated strip adapted to be secured to the wall such that a hook member may be secured to the object by adhesive and hung on the elongated strip.

Generally speaking, a more effective means for safely holding books on a wall is desired. While on the one hand, the structure should provide a positive locking or mating of the hook member to the wall mounting means, the design must facilitate the placement and removal of the book or article from its mount. Furthermore, when one considers the considerable weight of books which would be stored in such fashion along the wall, balanced against the desirable small size of the hooking means to make it as innocuous as possible, considerable design constraints and problems are presented. There are also special stress problems generated by any mounting assemblies that require very detailed consideration of materials. One must also consider the shearing effects and pulling forces to which such materials are subjected in use. Therefore, while at first blush a satisfactory design of a hanging assembly appears to present a simplified problem, it is quickly apparent that solution to the many problems existing in the fabrication of a hanging device become quite complex.

In light of this background of the art, improvements are still desired for article hanging devices designed to provide an attractive low cost alternative to storing and displaying books, records and other articles. There is also a desire to be able to achieve unique decorative effects in providing such new hanging devices. Simplified, strong and serviceable products are also desired that facilitate easy placement and removal of stored articles onto walls or similar such vertical surfaces. Further improvements in the art are needed in order to achieve these and other objectives.

SUMMARY OF THE INVENTION

This invention is directed to an article hanging device which provides an attractive low cost alternative to storing and displaying books, records and similar articles. The invention embodies an inexpensive, easy to install storage device that takes minimal wall space and no floor space in contrast to the conventional means for storage. Furthermore, books of all sizes and weights, or other similar articles, can be displayed economically and decoratively according to the principles of this invention.

The article hanging device of this invention comprises two main components, a tab or tab-like sheet for securement to the article and an elongated rail for mounting on a vertical surface. The tab-like sheet and rail structures are especially designed to facilitate quick and easy storage and retrieval by special interaction of the tab with the rail. The device overcomes or alleviates problems mentioned in the background of this invention by providing a hook means integrally formed in the tab-like sheet continuously along an edge thereof. The hook means comprises a protrusion for extending generally parallel to the vertical surface or wall onto which the book is mounted. The protrusion has a substantially planar inside portion terminating into a rounded channel and a convex radius with said radius spaced apart opposite the protrusion inside portion to form the hook means. The protrusion inside portion and the convex radius are adapted to mate or coact respectively with corresponding surfaces of the elongated rail mounted on the vertical surface. The rail has an elongated knob with one side of the knob having a concave surface for mating with said convex radius of the hook means and, on the opposite side of said knob, a substantially flat portion is provided for mating with the protrusion inside portion of the hook means. By means of this unique structure, the article hanging device of this invention enables the article to be positioned easily as a function of the radius on the tab, thereby guiding the tab onto the rail knob as the book is lowered into position. The tab and rail mating surfaces positively lock or mate the tab to the rail and hold the article in place by cantilevering it upon wall mounting.

Other features of the inventive device enable other advantages to be achieved. In one form of the tab-like sheet, aluminum of sufficient high tensile strength is employed. A thin gauged high tensile metal of this type, when coated with a layer of adhesive, may be secured to the inside front and back covers of books, or to record album jackets, for instance, with relative ease. By means of the aluminum, the hook means may be made small and innocuous, yet strong enough to hold all types of books. This is achieved by combination of the hook means with a small mating knob on the rail. The mating radius and flat protrusion edges of the hook means, with intermediate rounded channel, provide for positive locking or mating of the tab edge to the corresponding mating surfaces of the rail. The small yet effective hook means design in aluminum has been found to provide the needed strength requirements.

The preferred rail structure takes into consideration the stress created by the weight of the books and the characteristics of plastic material used to make the rail. In a preferred form, the elongated rail has an elongated knob with one side of the knob having a concave surface for mating with the convex radius of the hook means. On the opposite side of the knob, a substantially flat portion is provided for mating with the protrusion inside portion of the hook means. The opposite side of the knob extends and continues into a concave surface. Thus, two concave surfaces form the base of the knob portion of the rail and are positioned to spread the pulling forces exerted by the force of the hook means across the base of the rail. Such a structure reduces the shearing effects of those forces on the knob itself. Thus, by means of such a rail structure, the shearing effects on the rail and the tab are reduced dramatically, enabling heavier books to be supported by the assembly. The base of the rail also provides a surface through which screws or other means may secure the rail to a wall. In a further preferred form of the tab and rail assembly, the tab is also provided with a planar side edge opposite the hook means protrusion so that it may contact a corresponding planar base of the rail to keep the books aligned parallel to the wall and further support the cantilevering of the mounted article.

A further understanding of the article hanging device of this invention and the assembly will be understood along with its advantages with reference to the following detailed description.

DETAILED DESCRIPTION

In the detailed description which follows, reference will be made to the drawings wherein.

Figure 1:
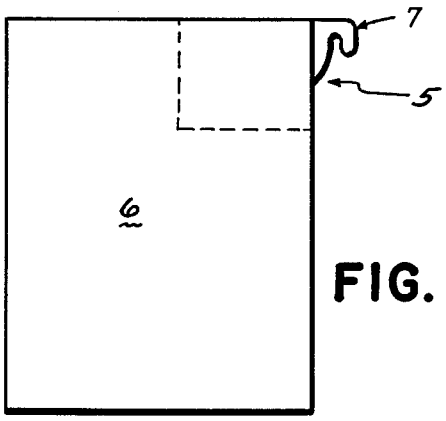
FIG. 1 is a side view of the inside of a cover of a book with the inventive tab secured thereto.
Figure 2:
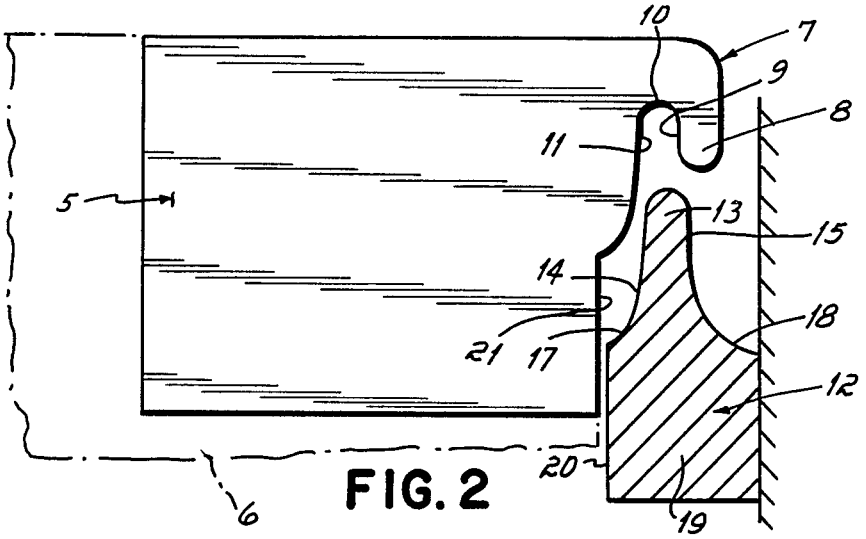
FIG. 2 is an enlarged view of the tab of FIG. 1 illustrating its mating cooperation with a rail shown in cross-section.
Figure 3:
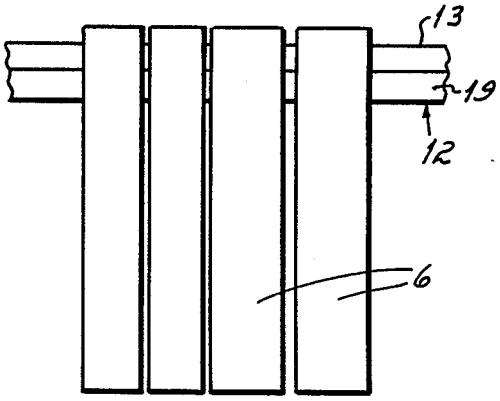
FIG. 3 is an elevational view of books mounted with the tab and rail of FIGS. 1–2.

With reference to FIGS. 1–3, an article hanging device is shown for removably mounting an article on a vertical surface. A thin tab-like sheet 5 sometimes herein referred to simply as a "tab", is provided with suitable adhesive for securing at least one side of the sheet to the article such as a book cover 6 as shown in FIG. 1. The tab sheet 5 has a hook means generally shown at 7 integrally formed therein continuously along an edge thereof. The hook means 7 comprises a protrusion 8 for extending generally parallel to the vertical surface onto which the article will be mounted. The protrusion 8 has a substantially planar inside portion 9 terminating into a rounded channel 10 and a convex radius 11. The convex radius 11 is spaced apart opposite the protrusion inside portion 9 to form the hook-like means 7. The elongated rail 12 is shown as mounted on a vertical surface such as a wall. The mode of cooperation between tab 5 and rail 12 is shown by FIG. 2. The rail 12 has an elongated knob 13 with one side of the knob having a concave surface 14 for mating with the convex radius 11 of the tab 5 and, on the opposite side of the knob, it has a flat portion 15 for mating with the protrusion inside portion 9 so that the book with its cover 6 may be mounted by cantilevering the hook means 7 on the rail 12.

The book hanging device for removably mounting a book 6 on a vertical wall functions in the following manner. Two tabs 5 are cut from thin gauge metal, preferably aluminum, or plastic and coated with a layer of adhesive that is paper backed for easy removal by the end user. Two tabs 5 are preferably pasted to the inside front and back covers of books when used to hang them. The hook means 7 of the tab 5 extends beyond the front edge of the book enabling it to be hooked onto the knob 13 portion of the rail 12 in the manner shown in FIG. 2. The rail 12 can be made of extruded plastic or metal, preferably ABS (acrylonitrile-butadiene-styrene polymer). Plastic offers the advantage of being less expensive and easily extruded in various lengths. For instance, lengths of the rail may be on the order of one or several feet long. Because the tabs become a permanent part of the book, it is essential that the hook portion of the tab be as small and innocuous as possible. On the other hand, the hook must be strong enough to hold all types of books. Such is achieved by the unique design characteristics of the tab 5 and rail 12 arrangement shown in the drawings. The configuration of the invention shown in FIG. 2 uses a close tolerance groove or channel 10 of the tab and rail knob 13 for positive locking or mating of the tab 5 to the rail 12. The channel and knob design holds books in place when pressure is exerted on the front portion of the books as would be the case if someone bumped into a row of books supported by a structure of this type, whereas a tab using a simple V-hook structure would be forced upward and out of its related slot in the rail if the books were bumped, for instance. The rounded edge portion of the channel 10 between the protrusion 8 and the opposed convex radius 11, provides strength such that when stress is applied to the hook means, it withstands the necessary forces. The weight bearing concave surface 14 of the rail 12 mates with the convex radius 11 of the hook means 7 and the substantially flat plane 15 of the rear portion of the knob 13 displaces the outward pulling force created by the cantilevered design upon mating with the substantially flat inside portion 9 of the protrusion 8. The tab and rail are designed to support the weight of heavy books. For example, a dictionary weighs approximately 5 pounds, and that weight would be distributed over the width of the book between 2 tabs which could be as narrow as 2 inches. Therefore, a thirty six inch rail must be able to support up to 18 books weighing 5 pounds each or approximately 100 pounds. Utilizing the structure of this invention, such weight bearing strength is achieved.

The rail design takes into consideration the stresses created by the weight of the books and the characteristics of the plastic material used to make the rail. The two arcs 17, 18 which form the base 19 of the knob 13 portion of the rail 12 are positioned to spread the pulling forces across the base of the rail 12 and to reduce the shearing effects of those forces on the knob itself. By using the arc surfaces 17, 18, the shearing effects on the rail 12 and the tabs 5 are reduced dramatically, thus enabling heavier books to be supported by the assembly. The base 19 of the rail 12 provides a surface 20 through which screws or other means pass in order to attach the rail 12 to a wall. Also as shown in FIG. 2, the base acts as a stabilizer in the event the books are bumped. In a preferred design, the tab convex radius 11 terminates in a substantially planar side 21 which is substantially parallel to the protrusion 8. The planar side 21 along the front edge of the tab 5 thus contacts the rail base planar surface 20 to keep the books aligned parallel to the wall and support the cantilevered mounting.

Figure 4:
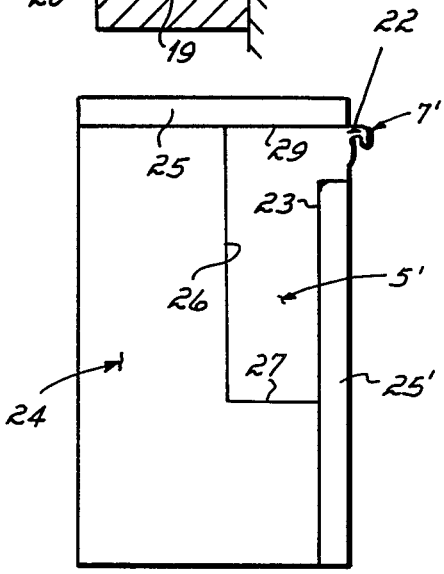
FIG. 4 illustrates another embodiment of this invention wherein the tab is especially adapted for use with books having a book-binding ridge formed along the inside book cover edge.

Thus, with the design of this invention, it may be appreciated that books and other articles with tabs secured thereto can be easily placed on the rail without having to see the area of contact between the tabs and the rail. Hanging books on the rail can be done entirely by feel. This feature also provides the benefit of allowing books to be stored in out of the way places such as high up on a wall or over doorways, where sufficient wall space exists between the door frame and the ceiling. The ease of positioning is a function of the radius of the tab whereby the tab is guided onto the knob of the rail where the book is lowered into position. In another embodiment as shown in FIG. 4, the aluminum hook means may be reinforced by including a stiffener indent 22 formed in the aluminum near the channel. The stiffener indent 22 adds strength to the hook area. The tab 5' of FIG. 4 is provided with an indentation 23 formed along an edge below the hooks means 7. The indentation 23 is adapted for securing the tab 5' onto the inside cover of a book 24 and adjacent to the ridges 25, 25' formed along the book cover edge. In this embodiment, the article hanging device is especially designed to overcome a bonding problem resulting when hanging books that are bound such that ridges exist on the inside covers. This is the case with most hardback books. The ridges 25, 25' are located usually ⅓ of an inch in from the outside edges of the cover 24 on the inside of the hardback book. The ridges prevent the tab employed in the manner as shown by FIG. 1 from making total contact with the inside cover surface, thus interfering with proper bonding. Complete bonding of the tab 5' is facilitated by flat contact with the inside of the book cover 24. The high spot created by the ridges causes the tab to lie on a slight angle. Thus, the embodiment shown in FIG. 4 compensates for the ridges of hardback books and allows the adhesive to make firm contact with more of the inside cover.

The tabs shown in the drawings are illustrated as being substantially rectangular with sharp corners, but slightly rounded corners may be used. However, it may be understood that various configurations of the tab may be utilized, yet the substantially rectangular tab affords the most preferred design from the standpoint of means for securing it to the surface and withstanding the forces of the cantilevering mounting. Slightly rounded end portions facilitate stamping for metal forming operations. More specifically, for a high tensile aluminum having a thickness on the order of about 0.025–30 inch, a substantially rectangular tab 5' as shown in FIG. 4 may be fabricated having the dimensions of overall length 26 of about 3.5 inches, with a bottom side 27 dimension of about 1.25 inches and a top dimension 29 of about 1.9 inches. A tab 5 of FIG. 1 for a paper back book may be made smaller. The hook means area made of metal fabrication of the type shown in FIG. 2 would be approximately dimensioned such that the protrusion would be approximately about 0.25 inch, having an inside protrusion portion 9 of about 0.12 inch, with a rounded channel 10 of about 0.05 inch and a convex radius 11 of about 0.45 inch. The radius formed by the tip of the protrusion 8 is about 0.5 inch with the arc angle of the channel 10 being about 180° and an arc angle of the convex radius 11 being about 35°. A substantially flat portion 21 of the tab 5, in which the convex radius terminates to complete the dimensional tolerances of the hook means, is about 0.14 inch. Thus, with reference to these dimensional tolerances, a person of ordinary skill will be able to readily fabricate a tab and rail of this invention.

Having described the invention and certain of its presently most preferred embodiments, it will become apparent that variations thereof may be made without departing from the spirit and scope of this invention.

What is claimed is:

1. An article hanging device for removably mounting an article on a vertical surface comprising a tab-like sheet having means for securing at least one sheet side to said article, said sheet having a hook means integrally formed therein continuously along an edge thereof, said hook means comprising a protrusion for extending generally parallel to and spaced from said vertical surface, said protrusion having a substantially planar inside portion substantially parallel to said surface terminating into a rounded channel and a convex radius, said convex radius spaced apart opposite said protrusion inside portion to form said hook means, said protrusion inside portion, said convex radius and rounded channel adapted to mate respectively with corresponding surfaces of an elongated rail mounted on said vertical surface and to guide the hook means onto the rail for positive locking of said hook means to said rail so that said article may be mounted by cantilevering said hook means on said rail.

2. The article hanging device of claim 1 wherein said convex radius terminates in a substantially planar side, said side substantially parallel to said protrusion, said planar side adapted to mate with a corresponding surface of said rail to further support said cantilevering.

3. The article hanging device of claim 1 wherein said means for securing said article is an adhesive coating along at least one side of said sheet.

4. The article hanging device of claim 3 wherein said adhesive means is a pressure sensitive adhesive.

5. The article hanging device of claim 1 wherein said sheet is made from aluminum.

6. The article hanging device of claim 5 wherein a stiffener indent is formed in said aluminum near the channel to reinforce said hook means.

7. The article hanging device of claim 1 especially adapted for mounting a book by adhesively securing said tab-like sheet to a face of the book cover or page.

8. The article hanging device of claim 7 wherein said sheet has an indentation formed along an edge below the hook means, said indentation adapted for securing said sheet onto the inside cover of a hard bound book adjacent the ridge formed along the book cover edge.

9. An article hanging device for removably mounting a book or similar device on a vertical surface comprising a tab-like sheet of aluminum having an adhesive secured thereto on one side for mounting onto said book or device, said sheet having a hook means integrally formed therein continuously along an egde thereof uncovered by adhesive, said hook means comprising a protrusion for extending generally parallel to and spaced from said vertical surface, said protrusion having a substantially planar inside portion substantially parallel to said surface terminating into a rounded channel and a convex radius, said concave radius spaced apart opposite said protrusion inside portion to form said hook means, said protrusion inside portion, said convex radius and rounded channel adapted to mate respectively with corresponding surfaces of an elongated rail mounted on said vertical surface and to guide the hook means onto the rail for positive locking of said hook means to said rail so that said article may be mounted by cantilevering said hook means on said rail.

10. The article hanging device of claim 9 comprising said sheet having an overall substantially rectangular shape.

11. The article hanging device of claim 9 adapted for mounting substantially rectangular shaped articles.

12. An article hanging device assembly for removably mounting an article on a vertical surface comprising in combination a tab-like sheet having means for securing at least one sheet side to said article, said sheet having a hook means integrally formed therein continuously along an edge thereof, said hook means comprising a protrusion for extending generally parallel to and spaced from said vertical surface, said protrusion having a substantially planar inside portion substantially parallel to said surface terminating into a rounded channel and a convex radius, said convex radius spaced apart opposite said protrusion inside portion to form said hook means, and an elongated rail for mounting on said vertical surface, said rail having a knob with one side of said knob having a concave surface for mating with said convex radius of said hook means and said knob having on the opposite side a substantially flat portion for mating with said hook means protrusion inside portion so that the tab-like sheet inside portion, convex radius and rounded channel are adapted to mate with said rail and to guide the hook means onto the rail for positive locking of said hook means to said rail for mounting said article by cantilevering said hook means on said rail.

13. The article hanging device of claim 12 wherein said rail has a base, a second concave surface for cooperation with said knob concave surface to displace mounting forces across the base of the rail.

14. The article hanging device of claim 12 wherein said convex radius terminates in a substantially planar side substantially parallel to said protrusion, said rail base having a substantially planar face to mate with said substantially planar side of said hook means for further supporting said article on said vertical surface.

* * * * *